US007983433B2

(12) United States Patent
Nemirovski

(10) Patent No.: US 7,983,433 B2
(45) Date of Patent: Jul. 19, 2011

(54) EARSET ASSEMBLY

(75) Inventor: Guerman G. Nemirovski, Shaker Heights, OH (US)

(73) Assignee: Think-A-Move, Ltd., Beachwood, OH (US)

( * ) Notice: Subject to any disclaimer, the term of this patent is extended or adjusted under 35 U.S.C. 154(b) by 1260 days.

(21) Appl. No.: 11/557,775

(22) Filed: Nov. 8, 2006

(65) Prior Publication Data

US 2007/0121974 A1 May 31, 2007

Related U.S. Application Data

(60) Provisional application No. 60/734,598, filed on Nov. 8, 2005.

(51) Int. Cl.
*H04R 25/00* (2006.01)

(52) U.S. Cl. ..... 381/318; 381/312; 381/328; 381/151; 381/380; 381/317

(58) Field of Classification Search ..... 381/312, 381/318, 326, 328, 325
See application file for complete search history.

(56) References Cited

U.S. PATENT DOCUMENTS

| | | | | |
|---|---|---|---|---|
| 3,633,705 | A | 1/1972 | Teder | |
| 3,995,113 | A | 11/1976 | Tani | |
| 4,017,797 | A | 4/1977 | Laessig | |
| 4,025,734 | A | 5/1977 | Aloupis | |
| 4,150,262 | A | 4/1979 | Ono | |
| 4,429,702 | A | 2/1984 | von Recklinghausen | |
| 4,533,795 | A | 8/1985 | Baumhauer, Jr. et al. | |
| 4,628,528 | A | 12/1986 | Bose | |
| 4,652,702 | A | 3/1987 | Yoshii | |
| 4,654,883 | A | 3/1987 | Iwata | |
| 4,922,471 | A | 5/1990 | Kuehnel | |
| 4,930,156 | A | 5/1990 | Norris | |
| 5,003,606 | A | 3/1991 | Bordewijk | |
| 5,033,090 | A * | 7/1991 | Weinrich | 381/318 |
| 5,138,663 | A | 8/1992 | Moseley | |
| 5,149,104 | A | 9/1992 | Edelstein | |

(Continued)

FOREIGN PATENT DOCUMENTS

CH 678692 10/1991

(Continued)

OTHER PUBLICATIONS

Sound Radio Products, "Better Living Through Wireless Technology", 2001, http://www.soundradio.com/en-921.html.

*Primary Examiner* — Curtis Kuntz
*Assistant Examiner* — Sunita Joshi
(74) *Attorney, Agent, or Firm* — Renner, Otto, Boisselle & Sklar, LLP

(57) ABSTRACT

Disclosed is an earset assembly that has a housing having a microphone port and a speaker port. A microphone is enclosed by the housing and has first and second input ports. The first input port is acoustically coupled to the microphone port to detect air pressure changes of the ear of a user. A speaker is enclosed by the housing and has an output port acoustically coupled to the speaker port to broadcast sounds to the user. The output port is acoustically coupled to the second input port of the microphone so that the microphone cancels at least a portion of feedback from the sounds broadcast by the speaker and detected at the first input port of the microphone.

21 Claims, 3 Drawing Sheets

U.S. PATENT DOCUMENTS 5,164,984 A 11/1992 Suhami et al.
5,251,263 A 10/1993 Andrea et al.
5,280,524 A 1/1994 Norris
5,298,692 A 3/1994 Ikeda et al.
5,327,506 A 7/1994 Stites, III
5,363,444 A 11/1994 Norris
5,373,555 A 12/1994 Norris et al.
5,426,719 A 6/1995 Franks et al.
5,448,637 A 9/1995 Yamaguchi et al.
5,606,607 A 2/1997 Yamaguchi et al.
5,659,156 A 8/1997 Mauney et al.
5,659,620 A 8/1997 Kuhlman
5,664,014 A 9/1997 Yamaguchi et al.
5,740,258 A 4/1998 Goodwin-Johansson
5,790,684 A 8/1998 Niino et al.
5,812,659 A 9/1998 Mauney et al.
5,812,978 A 9/1998 Nolan
5,832,094 A * 11/1998 Le Her ..... 381/328
5,844,824 A 12/1998 Newman et al.
5,844,984 A 12/1998 Yamaguchi et al.
5,878,396 A 3/1999 Henton
5,881,159 A 3/1999 Aceti et al.
5,896,451 A 4/1999 Deas
5,933,506 A 8/1999 Aoki et al.
6,004,274 A 12/1999 Nolan et al.
6,022,311 A 2/2000 Juneau et al.
6,024,700 A 2/2000 Nemirovski et al.
6,072,884 A 6/2000 Kates
6,094,492 A 7/2000 Boesen
6,156,585 A 12/2000 Gogoi et al.
6,175,633 B1 1/2001 Morrill et al.
6,283,915 B1 9/2001 Aceti et al.
6,408,081 B1 6/2002 Boesen
6,456,721 B1 9/2002 Fukuda
6,503,197 B1 1/2003 Nemirovski
6,560,468 B1 5/2003 Boesen
6,567,524 B1 5/2003 Svean et al.
6,574,345 B1 6/2003 Huang
6,647,368 B2 * 11/2003 Nemirovski ..... 704/270
6,661,901 B1 12/2003 Svean et al.
6,671,379 B2 12/2003 Nemirovski
6,683,965 B1 1/2004 Sapiejewski
6,691,073 B1 2/2004 Erten et al.
6,718,043 B1 4/2004 Boesen
6,728,385 B2 4/2004 Kvaloy et al.
6,741,718 B1 5/2004 Brumitt et al.
6,754,358 B1 6/2004 Boesen et al.
6,754,359 B1 6/2004 Svean et al.
6,795,562 B1 * 9/2004 Gunnersen et al. ..... 381/325
6,819,762 B2 11/2004 Jones et al.
6,917,688 B2 7/2005 Yu et al.
6,952,483 B2 10/2005 Boesen et al.
7,039,195 B1 * 5/2006 Svean et al. ..... 381/71.6
2001/0017926 A1 8/2001 Vicamini
2002/0118852 A1 8/2002 Boesen
2002/0186858 A1 12/2002 Masuda et al.
2003/0147544 A1 8/2003 Lichtblau
2003/0185403 A1 10/2003 Sibbald
2004/0125979 A1 7/2004 Elidan et al.
2004/0197002 A1 10/2004 Atsumi et al.
2005/0013456 A1 1/2005 Chalupper et al.
2005/0069161 A1 * 3/2005 Kaltenbach et al. ..... 381/312
2005/0147266 A1 7/2005 Eggers et al.
2005/0157895 A1 7/2005 Lichtblau
2009/0080670 A1 3/2009 Solbeck et al.

FOREIGN PATENT DOCUMENTS

GB 2197158 5/1988
GB 2234882 2/1991
JP 10023578 1/1998
SE 526085 6/2005
WO 9410818 5/1994

* cited by examiner

EARSET ASSEMBLY

RELATED APPLICATION DATA

This application claims the benefit of U.S. Provisional Patent Application No. 60/734,598 filed Nov. 8, 2005, which is incorporated by reference in its entirety.

TECHNICAL FIELD

The present invention generally relates to a earset assembly having a microphone and a speaker that can be placed with respect to an ear.

BACKGROUND

Wireless mobile telephones, also referred to as a cellular telephones, have become exceedingly popular communication devices. The vast majority of mobile telephones contain a transceiver (e.g., a radio frequency, or RF, transceiver) for establishing a communication link with a remote location, such as a cell phone tower. In order to carry out a conversation with another person using the mobile telephone, the user must hold the telephone adjacent the ear and mouth of the user. This presents the disadvantage of occupying the use of at least one of the user's hands. In many situations, hands free use of the mobile telephone is desirable. The same is true for receivers, or handsets, found in hard-wired telephone systems. For example, the user of a hard-wired telephone system may wish to type on a computer while speaking on the phone. In addition, medical professionals and others have expressed concerns relating to the health of mobile telephone users who engage in prolonged use of an RF transceiver adjacent their head.

There are many commercially available "handsfree" headsets available to users of wireless and/or hard-wired telephone systems. These headsets are intended to assist the user in carrying out a conversation without the use of the user's hands and to locate the telephone away from the user's head. These headsets typically include an ear piece containing a speaker. The ear piece can be removably placed with respect to the user's ear and broadcasts sounds to the user's ear. The headsets also typically include a microphone disposed on a support member that positions the microphone with respect to the user's mouth. The microphone is used to detect speech and other vocalizations emanating from the mouth of the user. The detected sounds are converted into an electrical signal and transmitted by the telephone to a backbone telecommunications network and onto the telephone of another person. In this manner, the user can carry out a fully duplexed conversation with the other person.

However, the headsets can be cumbersome to use. More particularly, care must be taken to ensure that the microphone is properly positioned and that the microphone maintains that position. The need to adjust the headset during a conversation can be distracting to the user. In addition, improper positioning of the microphone may lead to poor and/or unreliable detection of the user's speech. This problem is compounded by the common occurrence of the microphone detecting environmental noise, such as the sound of a passing vehicle, conversations taking place near the user, and the like. The detected environmental noise is ultimately transmitted by the telephone.

Some headsets have suffered from unacceptable levels of feedback from the speaker to the microphone. In addition, many headsets continue to detect a relatively high amount environmental noise. Electrical circuitry has been employed to address the feedback and/or suppress environmental noise to improve headset performance, but the electrical circuitry often requires a power source and adds complexity and cost to the headset.

Accordingly, there exists a need in the art for an easy to use earset assembly that adequately detects the user's speech and/or other sounds from the user's ear while minimizing the effects of environmental noise and/or feedback from a speaker.

SUMMARY OF THE INVENTION

According to one aspect of the invention, an earset assembly includes a housing having a microphone port and a speaker port; a microphone enclosed by the housing and having first and second input ports, the first input port acoustically coupled to the microphone port to detect air pressure changes of the ear of a user; and a speaker enclosed by the housing and having an output port acoustically coupled to the speaker port to broadcast sounds to the user and the output port acoustically coupled to the second input port of the microphone so that the microphone cancels at least a portion of feedback from the sounds broadcast by the speaker and detected at the first input port of the microphone.

According to another aspect of the invention, an earset assembly includes a housing having first and second microphone ports; and a microphone enclosed by the housing and having a first input port acoustically coupled to the first microphone port to detect air pressure changes of the ear of a user and a second input port acoustically coupled to the second microphone port so that the microphone cancels at least a portion of ambient noise detected at the first input port of the microphone.

BRIEF DESCRIPTION OF DRAWINGS

These and further features of the present invention will be apparent with reference to the following description and drawings, wherein.

DESCRIPTION

Figure 1:
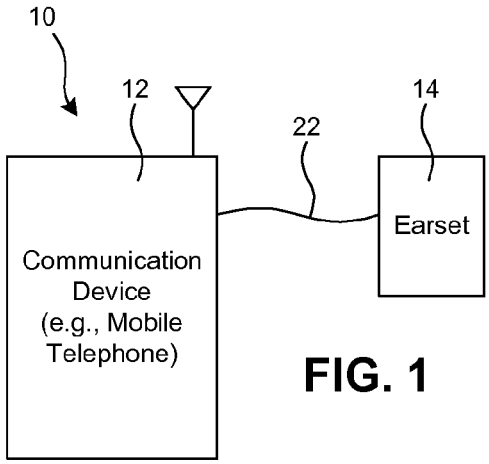
FIG. 1 is a schematic block diagram of telecommunications system that includes an earset in accordance with the present invention.

In the description that follows, like components have been given the same reference numerals, regardless of whether they are shown in different embodiments. To illustrate an embodiment(s) of the present invention in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

The present invention is directed to an earset assembly that can be used with, for example, a communication system that allows a user to speak with a remotely located person. As will be discussed below, other possible uses for the earset assembly exist. In one embodiment, the earset assembly includes a microphone and a speaker supported by a housing. The housing is retained by the ear of the user and allows for hands free use of the communication system while carrying on a conversation with the remotely located person. The microphone is arranged to detect sounds emanating or coming out of the ear (or air pressure changes occurring within the ear) to accurately and reliably detect the speech of the user. The speaker is arranged to broadcast sounds to the ear of the user and is arranged with the microphone to reduce the influence of feedback from speaker to microphone. In another embodiment, the earset assembly is arranged to suppress the influence of external sounds, referred to herein as environmental noise or ambient noise. For purposes of the description herein, ambient noise includes sounds generated external to the ear and sounds emanating from the mouth of the user. When used as part of a communication system, the earset assembly allows for separation of a speech input device for a mobile telephone from an RF transceiver of the telephone.

Without intending to be bound by theory, the earset assembly of the present invention allows a user to speak more quietly (e.g., such as at a whisper or near whisper) than is found with conventional headsets. This allows for more private conversations and less disruption to others. There is also a body of evidence indicating that the softer one speaks, the less concentration is needed to maintain the conversation, thereby allowing the individual at least to partially engage in other activities while speaking.

The earset assembly of the present invention does not rely on the detection of sound that has emanated directly from the user's mouth. Therefore, there is a reduced need to repeatedly adjust the position of the earset that would otherwise distract the user and require the use of the user's hands. Also, the size and arrangement of the earset is small, resulting in a more cosmetically appealing device. Such a device can be used unobtrusively. For example, the device would not be noticed as much by others when used in public, or by a person being observed by others, such as, for example, a television news anchor or a secret service agent.

It is noted that the term air pressure changes is used in its broadest sense and includes, for example, sound waves (whether audible to the user or not), pressure fluctuations, vibrations, resonations and the like. In addition, the term air pressure changes as used herein includes vibrations conducted by the bones and tissue of the user that are carried to ear. These conducted vibrations can vibrate the anatomical parts of the ear and/or the housing and lead to sound detection by the microphone. The air pressure changes may be caused by one or more factors, including vibrations of the ear drum, vibrations of bone within the ear, vibrations of other anatomical structures within the ear and vibrations conducted by the bones and/or tissue of the user to the ear and which invoke an air pressure change in and/or emanating from the ear.

As a result, the sensor can be used to detect a person's speech. It is also noted that the term speech is used in its broadest sense and includes spoken words and utterances, as well as other vocalizations produced by the user, including, for example, grunts, whistles, singing, coughs, "clicking" sounds made by movement of the lips or tongue, and the like. To facilitate the description herein, the event of sensing or detecting by the microphone will be referred to as detecting and that which is detected will be referred to as a change within the ear, or simply an air pressure change. The present invention monitors changes within and/or emanating from the human ear which occur instantaneously, or nearly instantaneously, in response to the speech of the person to provide a substantially real-time speech detection system. Other uses for the earset assembly include, for example, a thought detection system, a movement and/or voluntary physical action detection system, a voice recognition system, a medical diagnostic system and so forth. Collectively, these systems will be referred to as sound processing systems. Examples of various communication systems and/or sound processing systems in which the earset assembly described herein can be used are found in co-owned U.S. Pat. Nos. 6,024,700, 6,503,197, 6,47, 368 and 6,671,379, the disclosures of which are herein incorporated by reference in their entireties.

Turning now to the figures, FIG. 1 is a block diagram that illustrates a portion of a communications system 10 for establishing duplexed (two-way) audio communication between two or more individuals. The system 10 includes a communication device 12, such as a telephone. In the illustrated embodiment, the communication device 12 is a wireless telephone, such as mobile or cellular telephone. The device can establish communication with a communications network (not shown), or backbone network, that enables a user of the device 12 to carry on a conversation with a remotely located person using a remotely located communication device (e.g., another telephone) as is known in the art. It will be appreciated that the communication device 12 and/or any remote communication device (not shown) can be other types of devices, including hardwired (land line) telephones, radios, personal digital assistants (PDAs), portable or stationary computers, voice over internet protocol (VOIP) devices, etc. Also, the communications network can be a network of any type, such as telephone systems, the Internet, a WAN, or a LAN.

The communications system 10 includes an earset assembly, generally referred to by reference numeral 14. With additional reference to FIGS. 5-7, the earset 14 can include a microphone 16 and a speaker 18 that are supported by a housing 20. The physical arrangement and detailed operation of the earset 14 will be described more fully below. The microphone 16 is used to detect sounds in, near and/or emanating from the ear of the user (collectively referred to as air pressure changes of the ear) that result from, for example, speech of the user. The microphone 16 converts those detections into an electrical signal that is input to the communication device 12. The speaker 18 is used to transmit (i.e., broadcast) sounds to the user. These sounds can include sounds generated in response to signals received by the communication device 12 over the communications network. In this way, the earset 14 and communication device 12 can be used as a bidirectional communication apparatus.

In the illustrated, the earset 14 is coupled to the communication device using an appropriate set of conductors 22. The conductors can include a wire or wires coupling the microphone 16 to the communication device 12 and the conductors can include a wire or wires coupling the speaker 18 to the communication device 12. In some configurations, one conductor can be used as a common ground for the microphone 16 and the speaker 18. In another arrangement, the earset 14 can have a wireless interface with the communication device 12. For example, a Bluetooth or other appropriate transmitter/receiver arrangement can be used to relay an output signal of the microphone 16 to the communication device 12 and to relay an input signal of the speaker 18 to the earset 14.

Figure 2:
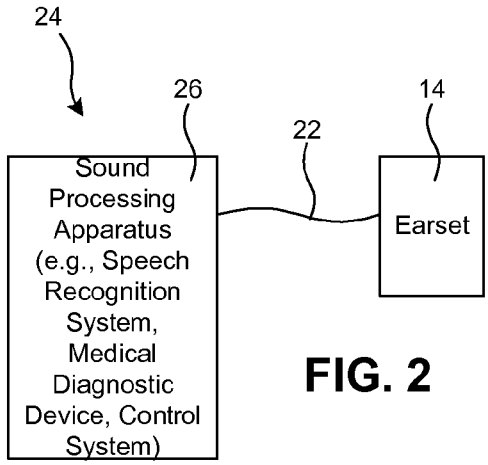
FIG. 2 is a schematic block diagram of a sound processing system that includes an earset in accordance with the present invention.

As indicated, the earset 14 can be used with other systems and devices other than the communication device 12. The general configuration of such a system 24 is shown in FIG. 2.

For example, the system 24 can include a sound processing apparatus 26 that receives an input signal corresponding to sounds detected by the earset 14 and/or transmits an output signal corresponding to sounds to be broadcast to the user by the earset 14. The signals can be transmitted over conductor(s) 22 or a wireless link. The sound processing apparatus 26 can include, for example, a logic executing system (e.g., a computer or programmable device) for carrying out a logic routine that processes and/or analyzes the output signal from the earset assembly 14.

In one example, the sound processing apparatus 26 can be a speech recognition system that converts detected sounds into text. In another example, the sound processing apparatus 26 can be a medical diagnostic system where detected sounds corresponding to the user's heart beat, breathing and/or gastrointestinal system are converted into visual and/or data forms for use by medical professionals. In another example, the sound processing apparatus 26 can be a control system where sounds corresponding to voluntary actions of the user are converted into control instructions for a device, such as a computer, wheelchair, item of machinery, etc. In this embodiment, the sounds can correspond to thoughts of the user as set forth in co-owned U.S. Pat. No. 6,024,700, movements of the user as set forth in co-owned U.S. Pat. No. 6,503,197, or spoken or other vocally generated sounds.

Figure 3:
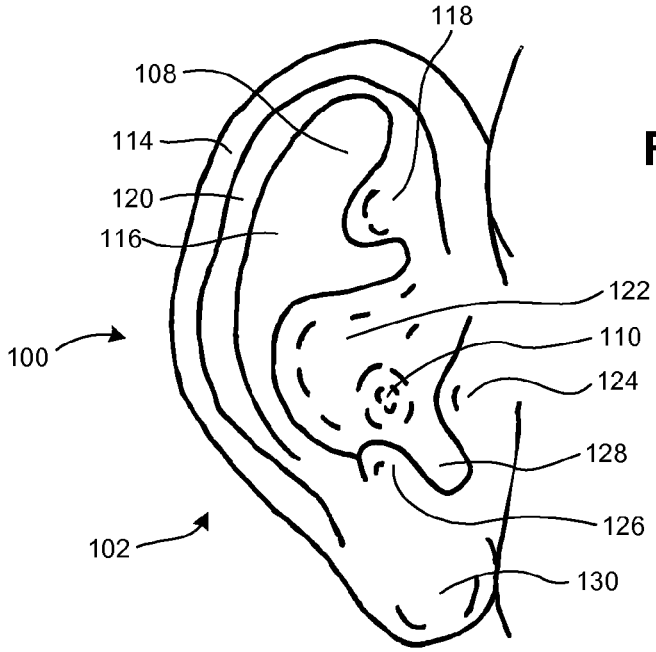
FIG. 3 is a schematic view of an ear.
Figure 4:
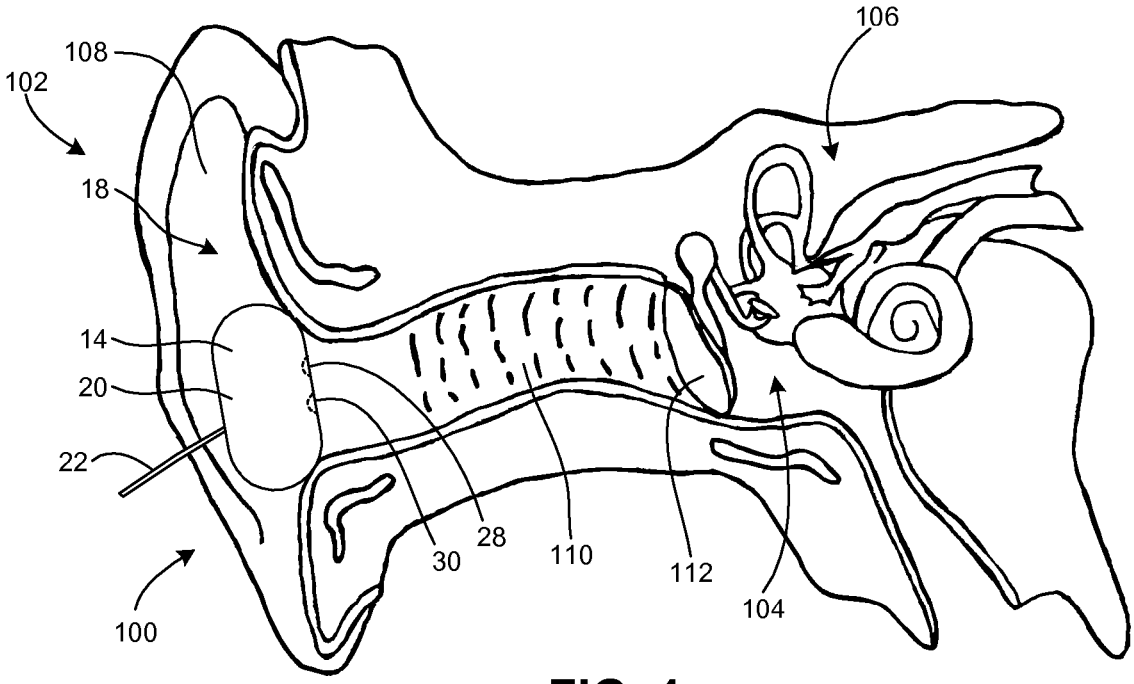
FIG. 4 is a cross-sectional view of the ear having an earset disposed with respect thereto.

Referring to FIGS. 3 and 4, an external view and a cross-sectional view of an ear 100 are respectively illustrated. FIG. 4 also schematically shows the earset 14 disposed with respect to the ear. According to Henry Gray's famous text "Anatomy", the human ear is divided into three parts, including the external ear 102, the middle ear (or tympanum) 104 and the internal ear (or labyrinth) 106. The middle ear 104 and the internal ear 106 will not be described in great detail herein. The external ear 102 includes an expanded portion, or a pinna 108 (also referred to as an auricle), and an ear canal 110 (also referred to as a meatus or auditory canal). The pinna 108 serves to collect vibrations of the air surrounding the person's head. The ear canal 110 conducts those vibrations to the tympanum, or ear drum 112.

The pinna 108 has a generally ovoid form with a larger end directed upward and having an outer surface that is irregularly concave and directed slightly forward. The pinna 108 has a number of eminences and depressions. Typically, the ear 100 has a prominent and curved rim, or helix 114. Generally parallel to the helix 114 is another curved prominence, or antihelix 116. The antihelix 116 bifurcates to form a triangular depression, or a fossa of the antihelix 118 (also referred to as a fossa triangularis). A narrow, curved depression located between the helix 114 and antihelix 116 is referred to as fossa of the helix, or scapha 120. The antihelix 116 also curves around a deep, capacious cavity, or the concha 122 (the concha 122 being divided by the commencement of the helix 114, or crus helicis, into an upper part, termed the cymba conchae, and a lower part, termed the cavum conchae). The concha 122 leads inward to an opening of the ear canal 110. In front of the concha 122 and projecting backward (usually over the opening of the ear canal 110) is a pointed eminence, or tragus 124. Opposite the tragus 124 is a tubercle, or antitragus 126. A notch-like depression, or incisura intertragica 128, is disposed between the tragus 124 and antitragus 126. A lobule 130 is present under the tragus 124 and antitragus 126.

The ear canal 110 is an oval cylindrical passage extending from a bottom of the concha 122 to the ear drum 112. The ear canal 110 is about an inch and a half in length when measured from the tragus 124 to the ear drum 112. When measured from the bottom of the concha 122 to the ear drum 112, the ear canal is about an inch long. The ear canal 110 forms a gradual "S-shaped" curve and is directed, at first, inward, forward and slightly upward (i.e., pars externa). The ear canal 110 then passes inward and backward (i.e., pars media) and then passes inward, forward and slightly downward (i.e., pars interna).

It is not certain what physical, chemical or neural mechanism causes or generates the changes in air pressure in or near the ear or sounds to some from the ear in response to various actions of the user. However, due to the connection of the oral cavity to the ear via the eustachian tube, speech and movements of the mouth may cause a change in air pressure or an airflow to or from the ear leading to a detectable air pressure change that can be detected by the microphone 16. Regardless of the exact physical, chemical or neural mechanism, empirical testing has confirmed that the user's speech generates pressure changes in, near or from the ear of the person. Consequently, the air pressure changes can be monitored in or near the ear and used to detect the speech of a user.

The present invention uses various forms of the terms "changes in air pressure", "changes within the ear" and sounds "emanating" or "coming from" the ear in their broadest sense to characterize the parameter being measured. Changes in air pressure may alternatively be characterized as sound waves. These sound waves (or vibrations) may propagate through mediums other than air, such as bone and tissue. As is well known by those skilled in the art, as a sound wave spreads out from its source its intensity falls off (the energy per unit area decreases with the inverse square of the distance), but the total energy is constant.

FIG. 4 illustrates the earset 14 inserted at least partially into the ear 100 of a person (i.e., at least within the cavity defined by the pinna 108, if not deeper within the ear 100 such as within the concha 122, at the opening of the ear canal 110 or slightly into the ear canal 110).

Figure 5:
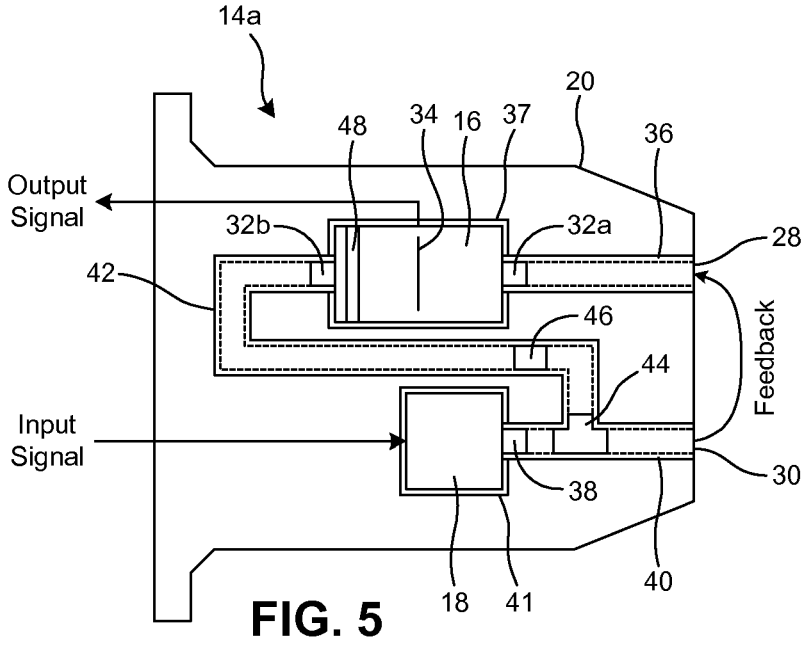
FIG. 5 is a schematic diagram of an example embodiment of an earset.

With additional reference to FIG. 5, the components of an embodiment of the earset 14*a* are schematically illustrated. The earset 14*a* includes the housing 20. Enclosed by the housing 20 is the microphone 16 and the speaker 18. The housing 20 can take on a number of different physical configurations. For example, the housing 20 can resemble the housing design of a hearing aid, and particularly a digital hearing aid, for similar insertion, or partial insertion, into the ear 100. Alternatively, the housing 20 can resemble a miniature earphone as found in conventional wireless telephone headsets or as used with personal audio/music players. The earset 14*a* can be retained by insertion into the ear 100, by a member disposed over or hanging from the ear and/or by a headset assembly.

The housing 20 can be made from any suitable material, such as plastic, rubber or a gel-like material. In a preferred embodiment, the housing 20, or portions thereof, is made of relatively rigid plastic, but alternative embodiments can includes making the housing from pliable material, sound absorbing (or sound proofing) material and/or include sound insulating material such as foam. The housing 20 defines a hollow cavity in which the operative components of the earset 14*a* are placed. Voids in the cavity can be unfilled or filled with foam or other material. In another arrangement, the inside surfaces of the housing 20 can be shaped to conform to the components contained therein so that the volume of any unoccupied cavities surrounding the various components is minimized.

The housing 20 is wider than an opening of the ear canal 110 and engages the pinna 108. In one embodiment, the housing 20 fits within the concha 122 and is retained, at least in part, by the tragus 124 and/or the antitragus 126. Such arrangement at least partially insulates the portions of the housing 20 that faces the ear canal 110 from externally generated noise and air pressure changes. However, as discussed in greater detail below, an operative feature of the earset 14*a* can be to allow sound waves originating from locations other than the ear to travel at least in part around the housing 20.

The housing 20 can be custom designed for the individual to form a close and comfortable fit with the ear of the individual. Alternatively, the housing can have a standard, or "stock", design for all individuals which is fabricated in a number of sizes. As one skilled in the art will appreciate, many alternative configurations for the housing 20 are possible and each are considered to fall within the scope of the present invention.

The earset 14*a* includes a microphone port 28 and a speaker port 30. The microphone port 28 and the speaker port 30 can be, for example, openings in the housing 20 that are arranged to be placed communicatively with the ear canal 110, such as adjacent the opening of the ear canal 110.

The microphone 16, which can be a unidirectional microphone, includes two input ports 32*a* and 32*b*. For example, the input ports 32*a* and 32*b* can include vibration receptor knobs that capture sound waves for a transducer element, such as a diaphragm 34, that functions as an operative component of the microphone 16. The diaphragm 34 converts sound energy into a voltage that serves as the output signal of the microphone 16. In the illustrated embodiment, the output signal is based on the ratio of the pressure changes in front of the diaphragm to the pressure changes in back of the diaphragm. Although not illustrated, the earset 14*a* can include a preamplifier to amplify the output signal before the output signal is input to the communication device 12 (FIG. 1) or the sound processing apparatus 26 (FIG. 2).

Although the ports 32*a* and 32*b* are illustrated as being on opposite sides of the microphone 16, other configurations are possible. For example, some suitable commercially available microphones have a cube-like configuration with input ports disposed on adjacent side surfaces.

A first of the input ports 32*a* is operatively coupled to the microphone port 28. In the illustrated embodiment, the coupling is accomplished by a tube 36 made from a suitable polymer material that acoustically and fluidically couples the microphone port 28 with the input port 32*a*. The tube 36 has an inside diameter that, when urged over the knob of the input port 32*a*, forms a secure fit therewith.

The foregoing arrangement allows detection of air pressure changes of the ear, such as sounds eminating from the ear. In particular, sound waves present at the microphone port 28 are communicated to the input port 32*a* via the tube 36. This arrangement reduces the detection of sound waves other than those present at the microphone port 28 by minimizing a conveyance path to the microphone 16 for such sound waves. Additional isolation of the microphone 16 can be accomplished by encapsulating the microphone 16 in a suitable polymer that conforms to the exterior surfaces of the body of the microphone 16, referred to herein as coating 37.

The speaker 18 includes an output port 38 that can include a vibration transmission knob that emits sound waves. The output port 38 is operatively coupled to the speaker port 30. In the illustrated embodiment, the coupling is accomplished by a tube 40 made from a suitable polymer material that acoustically and fluidically couples the speaker port 30 with the output port 38. The tube 40 has an inside diameter that, when urged over the knob of the output port 38, forms a secure fit therewith.

The foregoing arrangement allows transmission of sound waves from the speaker 18 to the ear. For instance, the sounds output at the speaker port 30 can be communicated to the ear canal 110 for reception by the user via the ear drum 112. In particular, sound waves generated at output port 38 are communicated to the speaker port 30 via the tube 40. This arrangement reduces the direct communication of sound waves from the speaker 18 to the first input port 32*a* of the microphone 16. Additional isolation of the speaker 18 can be accomplished by encapsulating the speaker 18 in a suitable polymer that conforms to the exterior surfaces of the body of the speaker 18, referred to herein as coating 41.

Although there is no direct communication path for sound waves from the speaker 18 to the first input port 32*a* of the microphone 32*a*, sound waves emanating from speaker port 30 may become present at the microphone port 28 and detected at input port 32*a*. The sound waves from the speaker 18 and detected by the microphone 16 at input port 32*a* will be referred to herein as feedback. Such feedback may be the result of sound waves from the speaker port 30 traveling through the air to the microphone port 28, inclusive of sound waves reflected by the ear and traveling through any structural members, such as the earset 14*a* and/or the user.

To minimize the presence of feedback in the output signal generated by the microphone 16, the second input port 32*b* of the microphone 16 is coupled to receive sound waves emitted by the output port of the 38 of the speaker 18. In the illustrated embodiment, the coupling is accomplished by a tube 42 made from a suitable polymer material that acoustically and fluidically couples the input port 32*b* with the tube 40. The tube 40 has an inside diameter that, when urged over the knob of the input port 32*b*, forms a secure fit therewith. The tubes 42 and 40 can be joined by fusing or adhering the tubes together or by mechanical fitting, such as a "Y" or "T" connector 44. The amplitude of the sound waves conveyed by tube 42 can be reduced by an acoustic resistance 46 inserted into the tube 42. The acoustic resistance 46 can be a metal sleeve (e.g., a tube) filled with appropriate sound dampening material. The acoustic resistance is selected to substantially equalize the pressure at the input ports 32*a* and 32*b* resulting from sound waves generated by the speaker 18, but not to introduce a propagation delay in the sound waves.

The microphone 16 is configured as a differential device. That is, opposing sound waves of the same magnitude that are respectively detected by the input ports 32*a* and 32*b* will be substantially or fully canceled at the diaphragm 34. Therefore, it will be appreciated that feedback detected at input port 32*a* can be at least partially canceled by the sound detected at input 32*b*. To improve the degree of feedback cancellation, the magnitude of the sound waves at the respective input ports 32*a* and 32*b* can be equalized. For instance, the value of the acoustic resistance 46 (e.g., in ohms) can be selected to account for a reduction in the amplitude of the feedback component occurring in the feedback path from speaker port 20 to input port 32*a*. If desired, additional acoustic resistance can be used. For example, an acoustic resistance member can be placed in the tube 40, more than one acoustic resistance member can be placed in the tube 42, and/or an acoustic resistance member 48 can be placed in the microphone 16 between the input port 32*b* and the diaphragm 34.

Another technique for improving the degree of feedback cancellation is to account for the propagation delay of the feedback component detected by input port 32*a* relative to the sound waves from the speaker 18 detected at input port 32*b*. For instance, the length of the various tubes 36, 40 and 42 can be adjusted to maximize cancellation. Both the amount of acoustic resistance and pathway lengths can be adjusted using theoretical modeling of earset 14*a* performance and/or experimental results.

In the schematic representation of the earset 14*a*, the tubes are shown as having square shape bends. It will be appreciated that the actual construction of the earset 14*a* may have tubes with curved bends. For example, the tubes can be made from flexible tubing. In one embodiment, the tubing can have an inner bore diameter of about 0.5 mm to about 3.0 mm.

Figure 6:
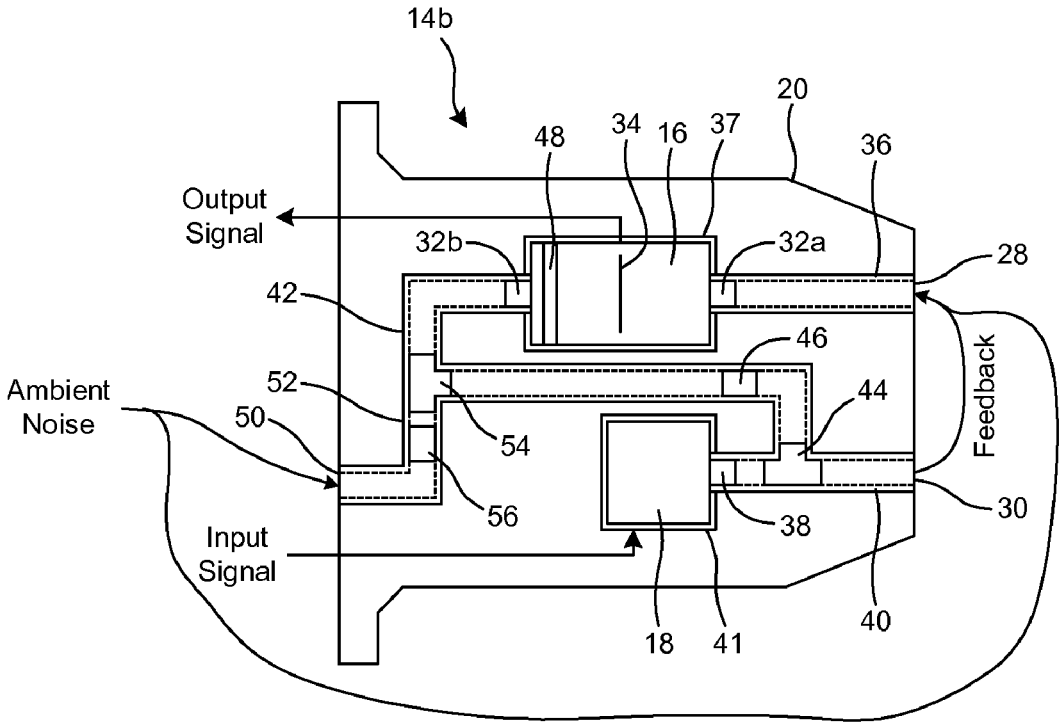
FIG. 6 is a schematic diagram of another example embodiment of an earset.

With additional reference to FIG. 6, shown is the earset assembly 14*b* configured to cancel feedback in the manner described with respect to the earset 14*a* of FIG. 5 and configured to reduce the amount of ambient noise present in the output signal of the microphone 16. For the sake of brevity, features in common between the earset 14*a* and the earset 14*b* will not be described in detail.

When the earset 14*b* is placed with respect to the ear 100, the microphone port 28 is a least partially shielded from ambient noise. For example, the housing 20 and the head of the user at least partially block externally generated sound waves before reaching the microphone port 28. In a preferred embodiment, the housing 20 does not seal the opening of the ear canal 110 and, as such, some ambient noise propagates around the housing 20. Therefore, there can be some ambient noise present at the microphone port 28 that is detected by the microphone 16 via input port 32*a*.

To reduce the amount of ambient noise in the output signal of the microphone 16, the housing can include a second microphone port 50 configured to communicate ambient noise to the second input port 32*b* of the microphone 16. In the illustrated embodiment, the communication of ambient noises to the second input port 32*b* is accomplished by a tube 52 made from a suitable polymer material that acoustically and fluidically couples the second microphone port 50 with the tube 42. As a result, an acoustic pathway is formed from microphone port 50 to input port 32*b*. The tubes 42 and 52 can be joined by fusing or adhering the tubes together or by mechanical fitting, such as a "Y" or "T" connector 54. The amplitude of the sound waves conveyed by tube 52 can be reduced by an acoustic resistance 56 inserted into the tube 52. The acoustic resistance 56 can be a metal sleeve (e.g., a tube) filled with appropriate sound dampening material.

The second microphone port 50, which can be an opening in the housing 20, can be located on an outwardly facing surface of the housing 20 that points generally away from the ear. For example, the second microphone port 50 can be in a generally opposite position on the housing with respect to the first microphone port 28.

Similar to the way feedback is canceled by the earsets 14*a* and 14*b*, ambient noise can be canceled by the earset 14*b* using the differential qualities of the microphone 16. For example, ambient noise detected at input port 32*a* can be at least partially canceled by the sound detected at input 32*b*. To improve the degree of ambient noise cancellation, the magnitude of the sound waves at the respective input ports 32*a* and 32*b* can be equalized. For instance, the value of the acoustic resistance 56 (e.g., in ohms) can be selected to account for a reduction in the amplitude of the ambient noise at the first microphone port 28 relative to that at the second microphone port 50.

Another technique for improving the degree of ambient noise cancellation is to account for the propagation delay of the ambient noise detected at input port 32*a* relative to ambient noise detected at input port 32*b*. For instance, the length of the various tubes 36, 40, 42 and 52 can be adjusted to maximize cancellation. Both the amount of acoustic resistance and pathway lengths can be adjusted using theoretical modeling of earset 14*b* performance and/or experimental results.

As indicated, the ambient noise can be considered to include sounds emanating from the mouth of the user, such as a speech. Such sound can travel through the air toward the ear of the user where some of the sound will be present at the second microphone port 50 and will become detected by the microphone 16 via the second input port 32*b*. Also, some of the sound from the user's mouth may pass around the housing 20 and be present at the first microphone port 28. This sound can be detected by the microphone 16 via the first input port 32*a*. In the manner described above, the sound from the mouth of the user can become at least partially canceled. As will be appreciated, air pressure changes of the ear (e.g., including sounds corresponding to those emanating from the user's mouth but emanating from the ear of the user) will be primarily present at the first microphone port 28 with little or no presence at the second microphone port 50. As a result, sounds from the ear of the user will be detected by the microphone 16 and represented in the output signal generated by the microphone 16.

In some systems, it may be desirable to reduce the presence of ambient noise in the signal processed by the system, but there is no need for a speaker to broadcast sounds to the user. For example, a speech recognition system may not have a need for a speaker. As a result, the configuration of the earset 14 can be modified from those shown in FIGS. 5 and 6 for use with systems where a speaker is not needed.

Figure 7:
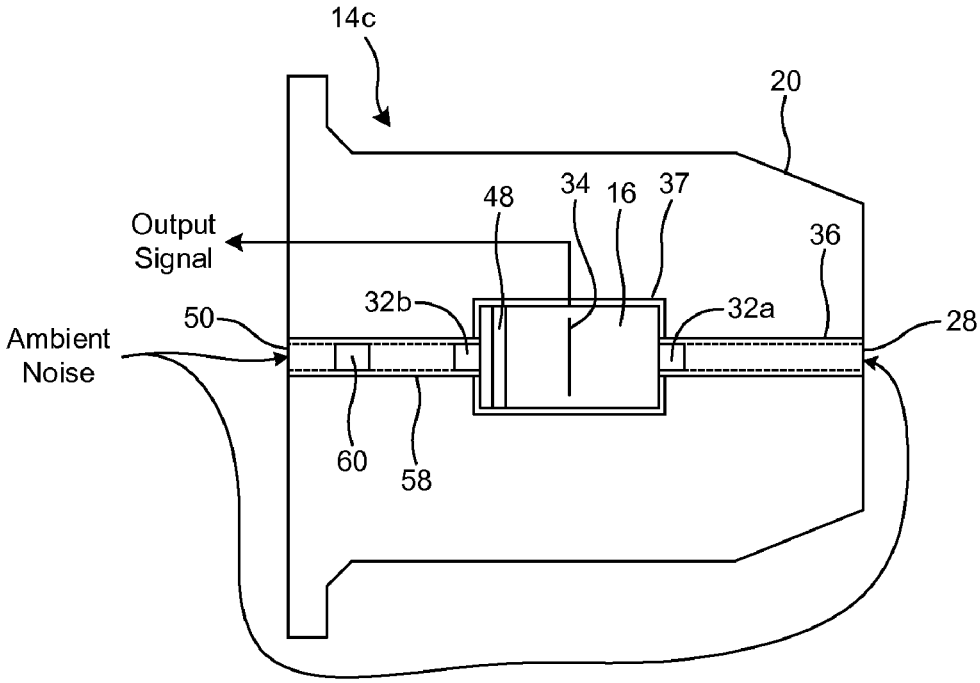
FIG. 7 is a schematic diagram of yet another example embodiment of an earset.

With additional reference to FIG. 7 shown is an earset 14*c* configured with the microphone 16, but without the speaker 18. For the sake of brevity, features in common among the earsets 14*a*, 14*b* and 14*c* will not be described in detail. The earset 14*c* includes the microphone port 28 coupled to the first input port 32*a* with the tube 36 as described above. The earset 14*c* includes the second microphone port 50 coupled to the second input port 32*b* with a tube 58. The tube 58 acoustically and fluidically couples the input port 32*b* with the second microphone port 58 so as to convey sound waves present at the second microphone port 50 to the input port 32*b* of the microphone 16. The tube 58 has an inside diameter that, when urged over the knob of the input port 32*b*, forms a secure fit therewith.

Similar to the earset 14*b* of FIG. 6, the earset 14*c* of FIG. 7 can be reduce the amount of ambient noise present in the output signal of the microphone 16 by cancellation of opposing sound waves at the diaphragm 34 of the microphone 16. The amplitude of the sound waves conveyed by tube 58 can be reduced by an acoustic resistance 60 inserted into the tube 58. The acoustic resistance 60 can be a metal sleeve (e.g., a tube) filled with appropriate sound dampening material.

Similar to the way ambient noise is canceled by the earset 14*c*, ambient noise can be canceled by the earset 14*c* using the differential qualities of the microphone 16. For example, ambient noise detected at input port 32*a* can be at least partially canceled by the sound detected at input 32*b*. To improve the degree of ambient noise cancellation, the magnitude of the sound waves at the respective input ports 32*a* and 32*b* can be equalized. For instance, the value of the acoustic resistance 60 (e.g., in ohms) can be selected to account for a reduction in the amplitude of the ambient noise at the first microphone port 28 relative to that at the second microphone port 50.

Another technique for improving the degree of ambient noise cancellation is to account for the propagation delay of the ambient noise detected at input port 32*a* relative to ambient noise detected at input port 32*b*. For instance, the length of the tubes 36 and 58 can be adjusted to maximize cancellation. Both the amount of acoustic resistance and pathway lengths can be adjusted using theoretical modeling of earset 14*c* performance and/or experimental results.

For each of the earset 14 embodiments, it will be appreciated that the microphone port 28 can be moved closer to or further away from various anatomical structures within the ear 100 as desired for factors such as comfort and to optimize detection of the user's speech. For most applications, one earset 14 can be sufficient to detect speech and/or other sounds generated by the user. However, two earsets 14 can be used by positioning an earset with respect to each ear of the user.

In an alternative arrangement to the earsets 14 shown in FIGS. 5 to 7, the microphone 16 can be replaced with two matched microphones. A first of the microphones can be arranged to detect air pressure changes of the ear and a second of the microphones can be arranged to detect sounds external and adjacent the ear. The output of the second microphone can be delayed, such as with an all pass filter. The outputs of one or both of the microphones can be attenuated or amplified, if appropriate, and then combined by effectively subtracting the output of the second microphone from the output of the first microphone, for example. The resulting signal can be used by a communications device or other sound processing system.

Although particular embodiments of the invention have been described in detail, it is understood that the invention is not limited correspondingly in scope, but includes all changes, modifications and equivalents coming within the spirit and terms of the claims appended hereto.

What is claimed is:

1. An earset assembly, comprising:

a housing having a microphone port and a speaker port that are located in physical communication with an ear canal of a user when the earset assembly is retained by an ear of the user;

a microphone enclosed by the housing and having first and second input ports, the first input port acoustically coupled to the microphone port by a first tube so that sound waves present at the microphone port of the housing are communicated to the first input port of the microphone via the first tube so that the microphone detects air pressure changes occurring in the ear canal of the user, wherein the first tube is enclosed by the housing and wherein the coupling of the first input port of the microphone to the microphone port of the housing is closed to an environment surrounding the user; and a speaker enclosed by the housing and having an output port acoustically coupled to the speaker port by a second tube that is enclosed by the housing to broadcast sounds to the ear canal of the user and the output port acoustically coupled to the second input port of the microphone by a third tube that is enclosed by the housing, is separate from the first tube, and is acoustically joined with the second tube so that the microphone cancels at least a portion of feedback from the sounds broadcast by the speaker and detected at the first input port of the microphone by travel through the second tube, the ear canal and the first tube.

2. The earset assembly according to claim 1, wherein the microphone is a unidirectional microphone.

3. The earset assembly according to claim 1, wherein the input ports of the microphone are vibration receptor knobs and the output port of the speaker is a vibration transmission knob.

4. The earset assembly according to claim 1, wherein the air pressure changes occurring in the ear canal of the user include sound waves emanating from the ear that correspond to speech of the user.

5. The earset assembly according to claim 1, wherein the acoustic coupling from the output port of the speaker to the second input port of the microphone includes an acoustic resistance.

6. The earset assembly according to claim 1, wherein the microphone includes an acoustic resistance between the second input port and a transducer element.

7. The earset assembly according to claim 1, wherein the housing has a second microphone port acoustically coupled to the second input port of the microphone so that the microphone cancels at least a portion of ambient noise detected at the first input port of the microphone.

8. The earset assembly according to claim 7, wherein the ambient noise includes sounds emanating from the mouth of the user.

9. The earset assembly according to claim 7, wherein a fourth tube that is enclosed by the housing is used to establish the acoustic coupling of the second microphone port with the second input port of the microphone.

10. The earset assembly according to claim 9, wherein the fourth tube is acoustically joined to the third tube.

11. A communication system comprising the earset assembly of claim 1 and a telephone having a connection to the earset assembly to receive an output signal from the microphone and to transmit an output signal to the speaker.

12. A sound processing system comprising the earset assembly of claim 1 and a sound processing apparatus having a connection to the earset assembly to receive an output signal of the microphone.

13. The sound processing system according to claim 12, wherein the sound processing apparatus executes a logic routine to process the output signal.

14. The sound processing system according to claim 12, wherein the sound processing apparatus is a speech recognition system.

15. The sound processing system according to claim 12, wherein the sound processing apparatus is a medical diagnostic system.

16. The sound processing system according to claim 12, wherein the sound processing apparatus is a control system for a controllable device.

17. An earset assembly, comprising:

a housing having a first microphone port that is located in physical communication with an ear canal of a user when the earset assembly is retained by an ear of the user and a second microphone port that is open to an environment surrounding the user; and a microphone enclosed by the housing and having:

a first input port acoustically coupled to the first microphone port by a first tube so that sound waves present at the microphone port of the housing are communicated to the first input port of the microphone via the first tube so that the microphone detects air pressure changes occurring in the ear canal of the user, wherein the first tube is enclosed by the housing and wherein the coupling of the first input port of the microphone to the microphone port of the housing is closed to the environment surrounding the user; and a second input port acoustically coupled to the second microphone port by a second tube that is enclosed by the housing so that the microphone cancels at least a portion of ambient noise from the environment that is detected at the first input port of the microphone.

18. The earset assembly according to claim 17, wherein the acoustic coupling from the second microphone port to the second input port of the microphone includes an acoustic resistance.

19. The earset assembly according to claim 17, wherein the air pressure changes occurring in the ear canal of the user include sound waves emanating from the ear that correspond to speech of the user.

20. The earset assembly according to claim 17, wherein the ambient noise includes sounds emanating from the mouth of a user.

21. A sound processing system comprising the earset assembly of claim 17 and a sound processing apparatus having a connection to the earset assembly to receive an output signal of the microphone.

* * * * *